US012054309B2

(12) United States Patent
Katz et al.

(10) Patent No.: US 12,054,309 B2
(45) Date of Patent: Aug. 6, 2024

(54) BUCKET CONNECTOR

(71) Applicants: Dennis Katz, North Bend, WA (US); Mark Feucht, University Place, WA (US)

(72) Inventors: Dennis Katz, North Bend, WA (US); Mark Feucht, University Place, WA (US)

( * ) Notice: Subject to any disclaimer, the term of this patent is extended or adjusted under 35 U.S.C. 154(b) by 91 days.

(21) Appl. No.: 17/668,100

(22) Filed: Feb. 9, 2022

(65) Prior Publication Data

US 2022/0250795 A1 Aug. 11, 2022

Related U.S. Application Data

(60) Provisional application No. 63/147,457, filed on Feb. 9, 2021.

(51) Int. Cl.
*B65D 21/02* (2006.01)

(52) U.S. Cl.
CPC ..... *B65D 21/0224* (2013.01); *B65D 21/0233* (2013.01)

(58) Field of Classification Search
CPC .. B65D 21/0224; B65D 21/0233; B65G 1/14; F16B 2/22
See application file for complete search history.

(56) References Cited

U.S. PATENT DOCUMENTS 2,135,401 A * 11/1938 Kiff ..... B65D 21/0224 206/503
4,520,943 A * 6/1985 Nielsen ..... B65D 50/066 220/281
5,203,452 A * 4/1993 Small ..... H05K 13/0084 206/503
6,619,498 B2 * 9/2003 von Holdt, Jr. .... B65D 43/0256 220/792
7,086,551 B2 * 8/2006 von Holdt, Jr. .... B65D 43/0256 220/276
8,056,722 B2 * 11/2011 Lonczak ..... B65D 25/24 206/509
9,517,859 B2 * 12/2016 Borg ..... A47F 7/281
9,624,044 B2 * 4/2017 Wright ..... B65D 19/44
D790,791 S * 6/2017 Katz ..... D32/54
9,828,162 B2 * 11/2017 Bachman ..... B65D 81/361
9,932,146 B1 * 4/2018 Katz ..... B65D 67/02
(Continued)

*Primary Examiner* — Robert Sandy
*Assistant Examiner* — Louis A Mercado
(74) *Attorney, Agent, or Firm* — Dean A. Craine

(57) ABSTRACT

A connector is used to securely attach two nested, stacked buckets so they may be easily transported using the handle on the upper bucket but also maintains an air gap between the sidewalls of the buckets when in a nested, stacked configuration, enabling the buckets to be easily separated. Each bucket connector includes a biasing arm extending downward from an apron formed on the buckets. The biasing arm includes a hook that automatically engages the upper lip onto a lower bucket when the upper bucket is stacked inside the storage cavity formed in the lower bucket. The biasing arm disengages the hook from the upper lip. Formed on the biasing arm is a stop surface configured to limit the downward movement of the upper bucket into the storage cavity. The stop surface forms an air gap between adjacent sidewalls when the upper bucket is stacked over the lower bucket.

10 Claims, 7 Drawing Sheets

(56) References Cited

U.S. PATENT DOCUMENTS

| | | | | |
|---|---|---|---|---|
| 10,611,520 | B2 * | 4/2020 | Sussman | B65D 21/0224 |
| 11,584,566 | B2 * | 2/2023 | Rogers | B65D 21/0201 |
| 2006/0278553 | A1 * | 12/2006 | Diamond | B65D 25/32 206/515 |
| 2008/0105584 | A1 * | 5/2008 | Cecil | B65D 21/0224 220/729 |
| 2018/0134448 | A1 * | 5/2018 | Andreasen | B65D 21/0233 |
| 2020/0385174 | A1 * | 12/2020 | Schuster | B65D 21/0224 |
| 2022/0250795 | A1 * | 8/2022 | Katz | B65D 21/0224 |

* cited by examiner

BUCKET CONNECTOR

This utility patent application is based on and claims the filing date benefit of U.S. Provisional patent application (63/147,457) filed on Feb. 9, 2021.

Notice that the following patent document contains original material subject to copyright protection. The copyright owner has no objection to the facsimile or digital download reproduction of all or part of the patent document but otherwise reserves all copyrights.

BACKGROUND OF THE INVENTION

1. Field of the Invention

This invention pertains to devices used to hold nested, stacked buckets together for compact storage and allow the nested, stacked buckets to be easily transported using the top bucket's wire handle and allows the stacked buckets to be easily separated.

2. Description of the Related Art

Most 5 gallon buckets are cylindrical with thin sidewalls that converge downward and terminate at a closed, flat bottom. A rotating wire handle is attached to the opposite sides of the bucket that extends upward from the top edge of the bucket so the bucket can be easily transported with one hand.

Most 5-gallon buckets are manufactured in standard sizes 14 to 15 inches in height with a top opening 11.25 to 12 inches in diameter (OD) and a flat, circular bottom end panel approximately 10.25 to 11 inches in diameter (OD). Because the diameter and height of the buckets are standardized, the sidewalls converge downward at the same angle, which allows an upper bucket made by one manufacturer to slide into the lower bucket made by the same manufacturer or by different manufacturers.

Most buckets also include a circular upper lip formed around the top opening. The upper lip extends outward % to ⅜ inches from the outside surface of the bucket's sidewall and is designed to snap-fit into a groove formed in an optional lid.

Most 5 gallon buckets also include a lateral extending reinforcement collar, hereinafter called an apron, and one or more reinforcing rings. The apron is usually formed 2 to 3 inches below the upper lip. The thin, outward protruding reinforcement ring is usually located between the upper lip and the apron.

The apron includes a downward extending, thin outer wall with an apron cavity formed therein. The apron has a continuous bottom opening and a plurality of radially aligned rib-like structures, called partitions, that extend from the outside surface of the bucket to the inside surface of the apron's outer wall. The partitions that provide additional support are typically spaced apart and form a plurality of partition cavities between the partitions.

Homeowners and construction workers often have several empty buckets used for mixing different materials or hauling tools and supplies. Sometimes, workers need to transport or manually carry multiple buckets to different locations. Therefore, it would be desirable if multiple buckets could be stacked temporarily connected in a secure manner to be transported in a nested, stacked configuration using the handle on the upper bucket.

It is also well known that when nested and stacked, 5-gallon buckets become stuck and are difficult to pull apart.

This occurs when the upper bucket expands due to heat, excessive cargo weight, or when a layer of dirt is deposited on the bucket's adjacent surface. One way to prevent sticking is to limit how far the upper bucket extends into the storage cavity in the lower bucket.

What is needed is a bucket connector that can be easily attached to or integrated into a standard bucket with converging sidewalls that allow the bucket to be selectively inserted into the storage cavity formed in a compatible lower bucket, so the buckets may be nested, and temporarily locked together so that the buckets can be transported in a nested, stacked configuration using the handle on the upper bucket. The bucket connector should also prevent the upper bucket from being excessively inserted into the storage cavity formed in the lower bucket so that the buckets can be easily separated.

SUMMARY OF TIE INVENTION

Disclosed herein is a bucket connector configured to be selectively attached or formed into the sidewalls on a standard 3 or 5-gallon bucket with downward, converging sidewalls and an upward extending handle. When inserted into the storage cavity in a similarly shaped lower 3- or 5-gallon lower bucket, the bucket connector enables the upper bucket to securely lock the two buckets together so the handle on the upper buck may be used to carry the buckets in a nested, stacked configuration. The bucket connector also includes features limiting how far the upper bucket extends into the storage cavity formed in the lower bucket. The bucket's sidewall is separated by an air gap when the buckets are nested and stacked. The air gap prevents the sidewalls of the two buckets from touching and creating frictional forces that prevent their separation.

There are several embodiments of the bucket connector described herein. In three embodiments, the bucket connector is configured to be selectively attached to a standard 3 or 5-gallon bucket found in the prior that has a top opening, an upper lip protruding from the sidewall near the top opening, at least one upper reinforcement ring located on the sidewall below the upper lip, and a circular apron located below the reinforcement ring. At least two bucket connectors are manually attached to the apron on opposite sides of the upper bucket in these embodiments. After attaching the bucket to the bucket, the bucket (called an upper bucket) is axially aligned with a similarly-shaped lower bucket with sidewalls compatible with the sidewalls on the upper bucket. When the upper bucket is pressed downward into the storage cavity in the lower bucket, the two bucket connectors connect to the upper lip of the lower bucket to lock the two buckets together.

Each bucket connector includes a biasing arm configured to be selectively attached to the bucket's apron. The biasing arm includes a hook that extends below the apron and automatically captures the upper lip on the lower bucket when stacked. The biasing arm is made of flexible material that enables the user to manipulate the biasing arm to manually unlock the upper bucket from the lower bucket.

Each bucket connector also includes a stop surface configured to limit the downward movement of the upper bucket on the lower bucket when the upper bucket is stacked over the lower bucket. An air gap is formed that separates the sidewalls of the two buckets.

Also disclosed is a fourth embodiment of the bucket connector incorporated into a modified apron formed on the bucket. The modified apron is longer than the apron described above and includes an outer wall with an integrally formed, downward extending hook. The length of the outer wall, the length of the hook are configured so that the hook automatically captures the outer lip formed on a lower bucket to lock the two buckets together. The outer wall of the apron is made of flexible material, which allows the user to apply downward force to the upper bucket causing the book to automatically engage the outer lip. The user then applies a deforming force to the outer wall that disengages the hook from the outer lip, which allows the bucket to separate.

Formed inside the modified apron are extended partitions that act as a stop surface that prevents excessive downward movement of the upper bucket into the storage cavity in the lower bucket.

In one embodiment, hook and extended partitions may be formed at separate locations on opposite sides of the bucket. It should be understood that the hook and extended partitions may be formed on the entire apron and thereby surrounding the bucket.

In all of the embodiments, when the buckets are nested and stacked, an air gap is maintained between the sidewalls of the upper and lower buckets. The actual width of the air gap depends on the draft of the buckets and how far the upper bucket fits into the storage cavity in the lower bucket. Typically, the air gap is 1/32 to 1/8 inches wide.

In all of the embodiments, the size and shapes of the components and their relative locations to each other are dependent on the size of the buckets, the thickness of the sidewalls of the buckets, the drafts on the buckets the locations of the aprons and any reinforcement rings.

DESCRIPTION OF THE PREFERRED EMBODIMENT(S)

Figure 1:
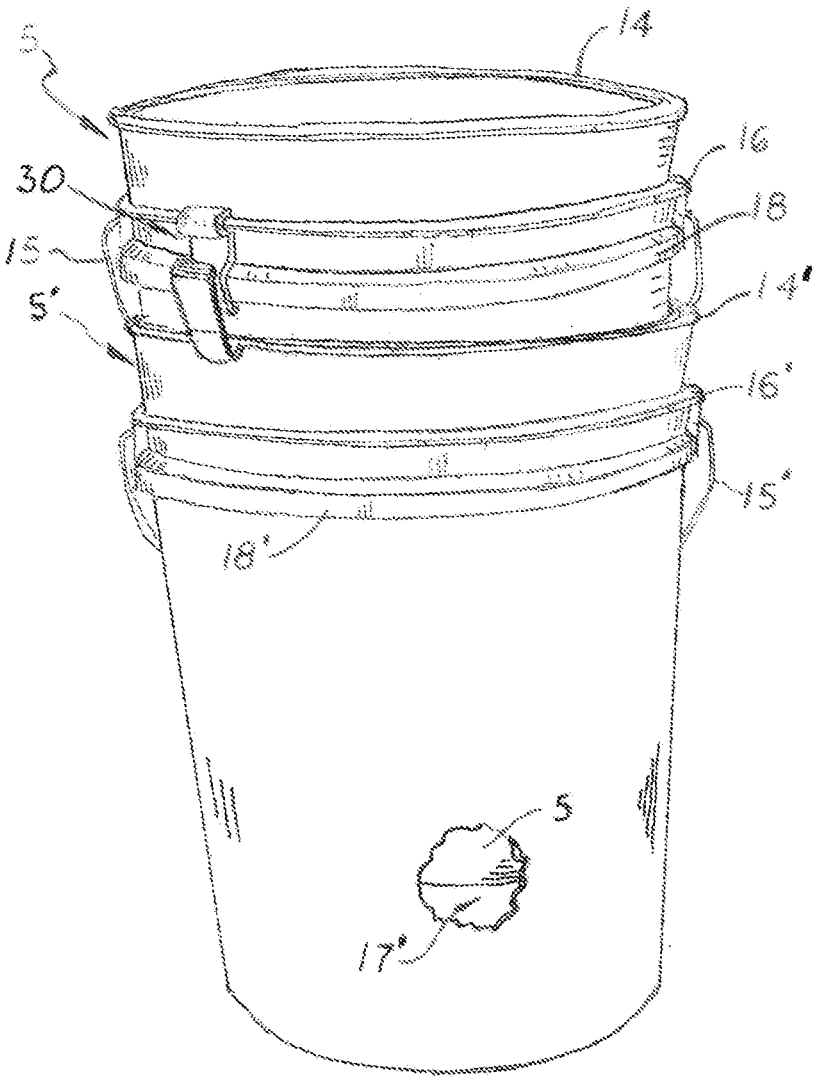
FIG. 1 is a side elevational view of two nested, stacked buckets. Each bucket includes an apron and at least one upper reinforcement ring located above the apron and shows one embodiment of the bucket connector used to hold the buckets together.
Figure 2:
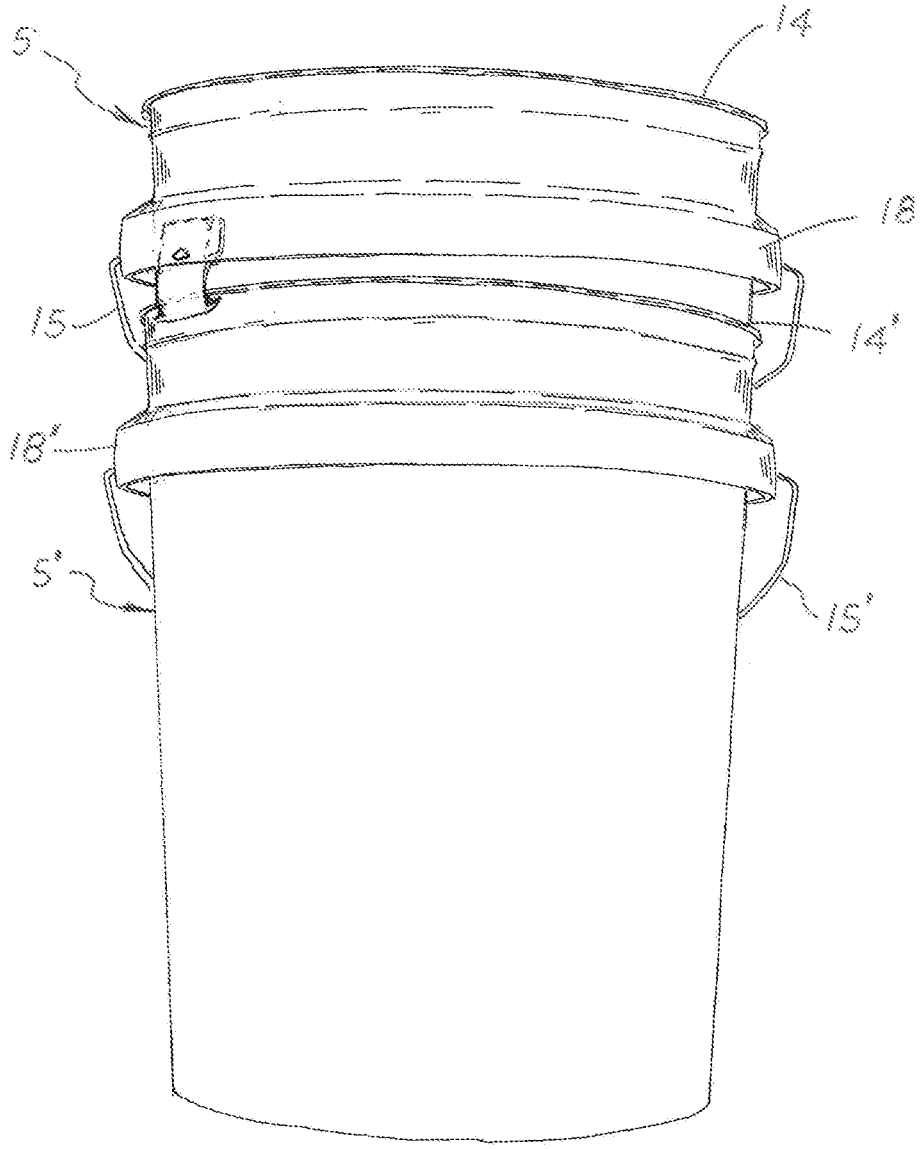
FIG. 2 is a side elevational view of two stacked, nested buckets, each with an apron and no upper reinforcement ring located above the apron and with another embodiment of the bucket connector used to hold the buckets together.
Figure 3:
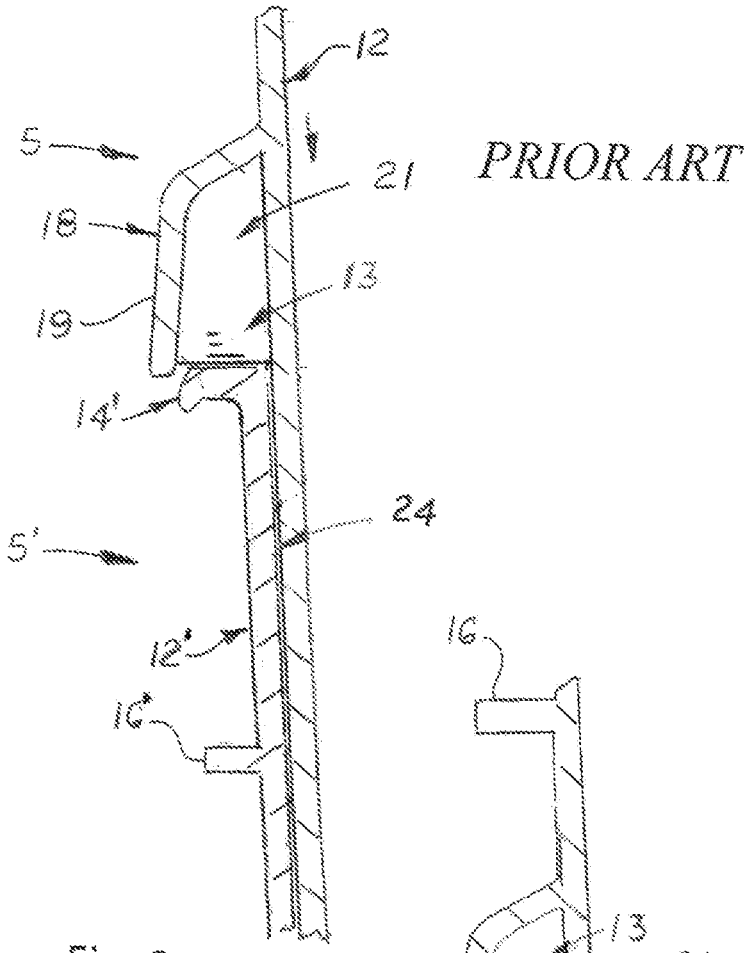
FIG. 3 is an illustration showing two stacked buckets found in the prior art showing the apron on the upper bucket being placed around the upper lip on the lower bucket and the air gap between the two buckets narrowing.
Figure 4:
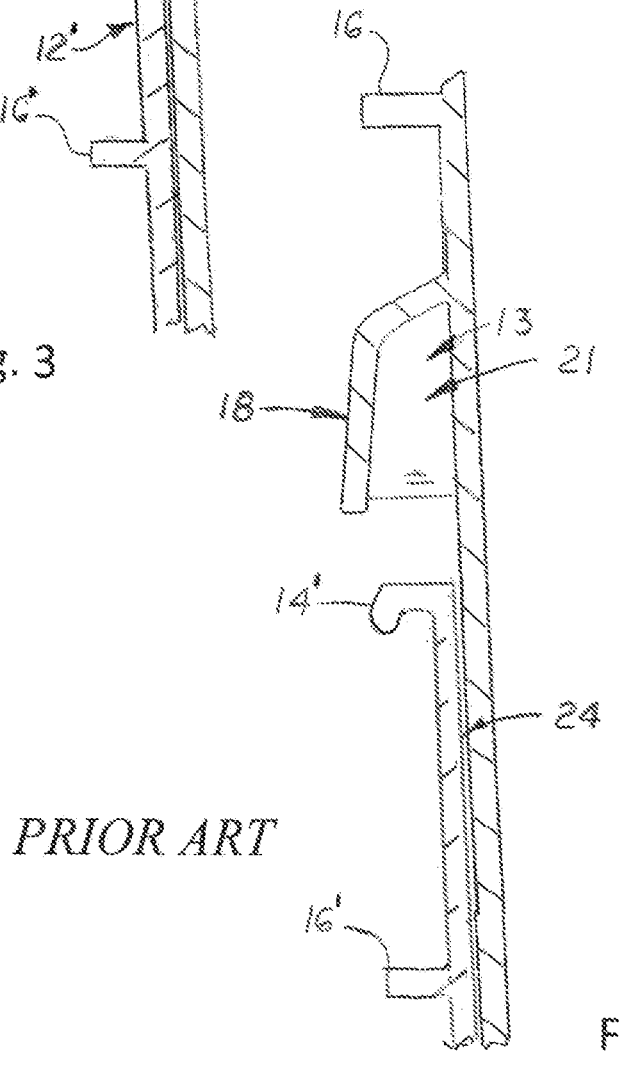
FIG. 4 illustrates two stacked buckets found in the prior art showing the apron on the upper bucket in an elevated position above the upper lip on the lower bucket that maintains the air between the two buckets.
Figure 5:
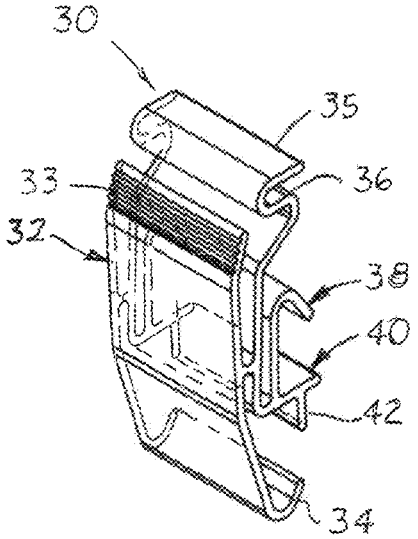
FIG. 5 is a side, top perspective view of the first embodiment of the bucket connector.
Figure 6:
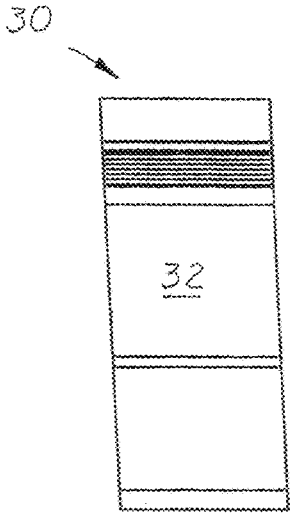
FIG. 6 is a front view of the bucket connector shown in FIG. 5.
Figure 7:
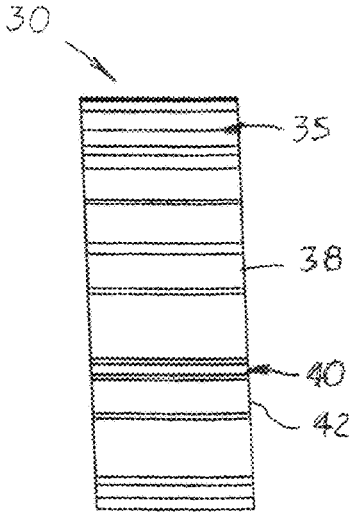
FIG. 7 is a rear view of the bucket connector shown in FIGS. 5 and 6.
Figure 8:
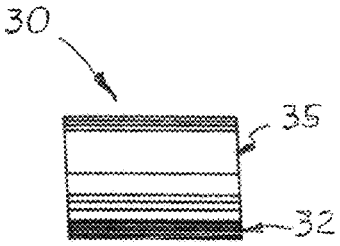
FIG. 8 is a top plan view of the bucket connector shown in FIGS. 5-7
Figure 9:
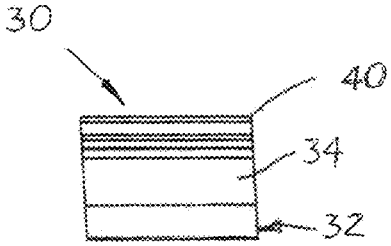
FIG. 9 is a bottom plan view of the bucket connector shown in FIGS. 5-10.
Figure 10:
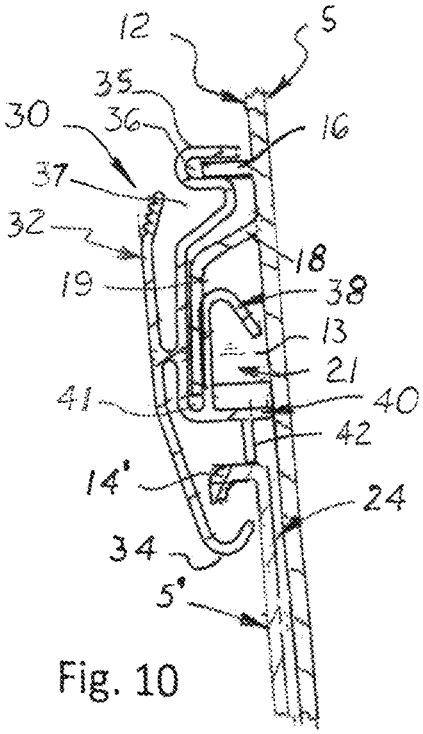
FIG. 10 is a sectional side elevational view of the clip shown in FIGS. 5-9 being used to hold two stacked buckets together.
Figure 11:
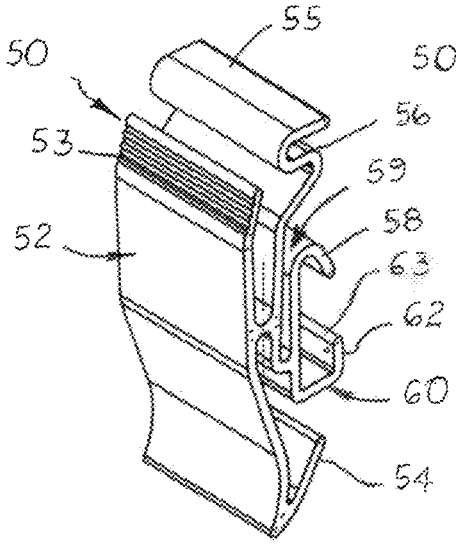
FIG. 11 is a side, top perspective view of a second embodiment of the bucket connector.
Figure 12:
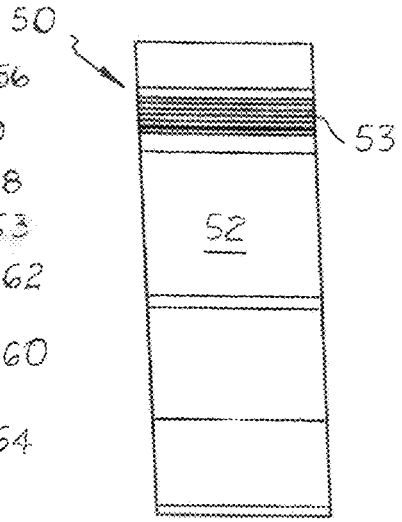
FIG. 12 is a front view of the bucket connector shown in FIG. 11.
Figure 13:
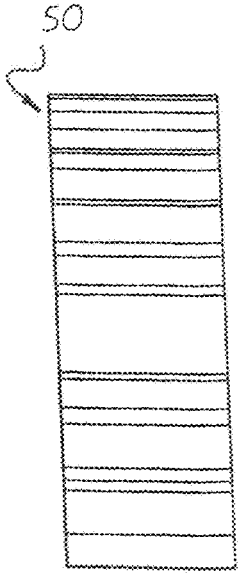
FIG. 13 is a rear view of the bucket connector shown in FIGS. 11 and 12.
Figure 14:
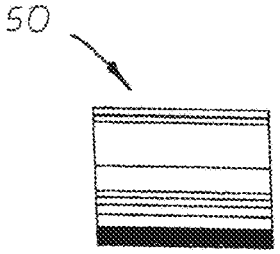
FIG. 14 is a top plan view of the bucket connector shown in FIGS. 11-13
Figure 15:
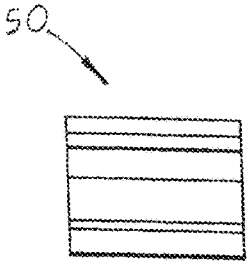
FIG. 15 is a bottom plan view of the bucket connector shown in FIGS. 11-14.
Figure 16:
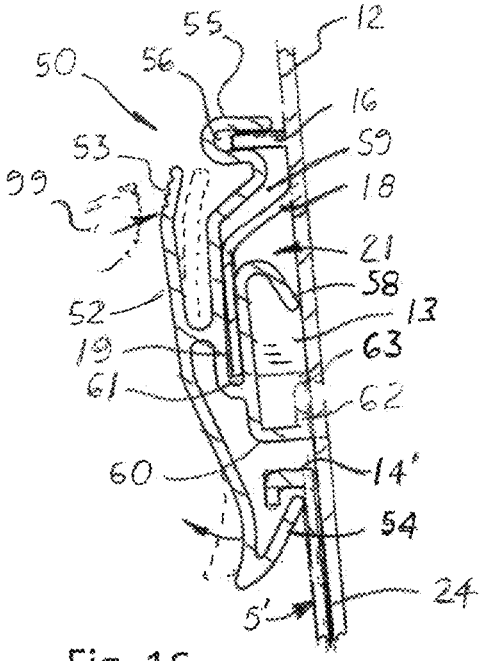
FIG. 16 is a sectional side elevational view of the clip shown in FIGS. 11-15 being used to hold two stacked buckets together.
Figure 17:
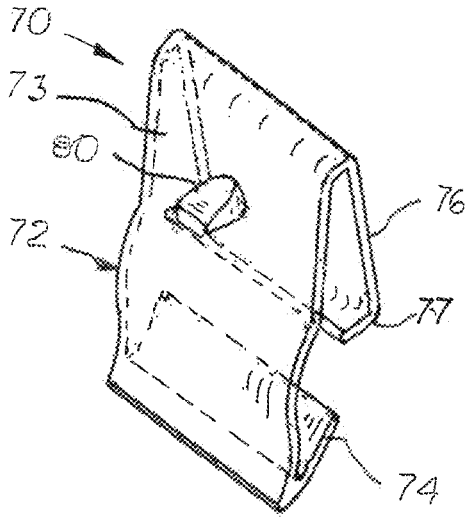
FIG. 17 is a side, top perspective view of a third embodiment of the bucket connector.
Figure 18:
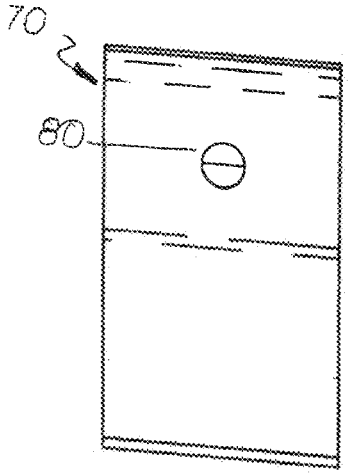
FIG. 18 is a front view of the bucket connector shown in FIG. 17.
Figure 19:
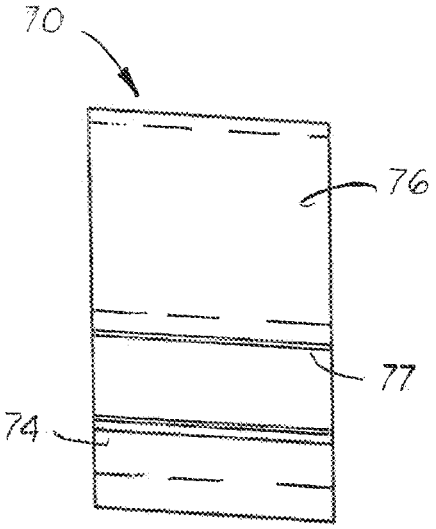
FIG. 19 is a rear view of the bucket connector shown in FIGS. 17 and 18

Bucket connectors 30, 50, and 70 are used to attach and stacked 3 or 5-gallon buckets 5, 5' for easy transport using the wire handle 15 on the upper bucket 5. The bucket connectors 30,50, and 70 also allow the buckets 5, 5' to be easily separated by maintaining an air gap 24 between the sidewalls 12, 12' of the stacked bucket 5, 5', respectively. Each bucket connector 30, 50 and 70 includes features that enable it to manually attach to an apron 18 formed on the sidewalls 12 on the upper bucket 5. Each bucket connector 30, 50 and 70 also includes features that block the upper bucket's 5 excessive downward movement in the storage cavity 17' formed on the lower bucket 5'. By blocking the excessive downward movement of the upper bucket 5 into the storage cavity 17' in the lower bucket 5', an air gap 24 is maintained between the sidewalls 12, 12' of the two buckets 5, 5', respectively, when stacked.

The first three embodiments of the bucket connectors 30, 50 and 70 are configured to be selectively attached to a circular apron 18 integrally formed on the sidewall 12 of the upper bucket 5. The first embodiment of the bucket connector, indicated by reference number 30 in FIGS. 5-10, includes a biasing arm 32 configured to extend vertically over the outside surface of the apron 18. Attached to the inside surface of the biasing arm 32 near its midline axis is a support member 35. The support member 35 is spaced apart from the biasing arm 32, thereby creating a void area 37 that enables the upper edge of the biasing arm to bend inward above the apron and towards the bucket's sidewall. The upper portion of the support member 35 bends and forms an optional horizontally aligned slot 36 configured to extend around and engage the outward extending upper ring 16 formed on the outside surface of the bucket 5 and above the apron 18.

Formed inside the lower portion of the biasing arm 32 is an abutment arm 40 that extends horizontally under the apron 18. The distal end of the abutment arm 40 presses against the outside surface of the bucket 5 adjacent to the apron 18.

Also attached to the abutment arm 40 is an upward extending alignment arm 38. The alignment arm 38 extends into the apron cavity 21 and then bends inward and presses against the outside surface of the sidewall of bucket 5. The alignment arm 38 includes a straight section that is spaced inward from the long, straight section of the support member 35 thereby forming a vertical slot 41, which receives the outer flange of the apron 18. The upper slot 36, the alignment arm 38 and the vertical slot 41 all act to hold the bucket connector 30 securely around the apron 18.

The lower end of the alignment arm 38 is integrally formed or attached to the inwardly directed abutment arm 40. Extending down from the bottom surface of the abutment arm 40 is a spacer arm 42. The distal end of the abutment arm 40 extends inward and presses against the outside surface of the bucket's sidewall 12. The spacer arm 42 is located near the midline axis of the abutment arm 40 and extends downward, and acts as a stop surface that prevents excessive upward movement of the upper lip 14' formed on the lower bucket 5' when the upper and lower buckets are being stacked.

The upper end 33 of the biasing arm 32 acts as a finger-pressing surface and extends upward and outward from the outer flange 19 of the apron 18. Formed on the lower end of the biasing arm 32 is a hook 34 configured to extend inward and capture the upper lip 14' on the lower bucket 5'. When the upper end 33 of biasing arm 32 is pressed inward, the hook 34 swings outward and disengages the upper lip 14', enabling the buckets to separate.

FIGS. 11-16 show a second embodiment of the bucket connector, indicated by reference number 50, including a biasing arm 52, a support member 55, and alignment arm 58 similar to the biasing arm 32, the support member 35 and alignment arm 38, respectively used in bucket connector 30. Attached to the biasing arm 52 is the support member 55 configured to wrap around the apron 18. The support member 55 also includes a slot 56 that receives the upper ring 16 on the bucket 5.

The alignment arm 58 is configured to extend under the apron 18. The distal end of the abutment arm 60 bends inward and forms a perpendicularly aligned alignment leg 62. Formed on the distal end of the alignment leg 62 is an upward extending alignment foot 63 that presses against the outside surface of the bucket 5. The proximal end of the alignment arm 58 bends upward and forms an inverted U clip. A gap 59 is formed between the proximal end of the alignment arm 58 and the inside surface of the lower section of the support member 55. The length of the abutment arm 60 is sufficient to extend below the apron 18 so that the alignment foot 63 acts as a stop surface that prevents downward movement of the upper bucket 5 over the lower bucket 5'.

Like alignment arm 38 on bucket connector 30, the alignment arm 58 extends into the apron cavity 21 and bends inward and presses against the inside surface of bucket 5. The lower portion of the alignment arm 58 is spaced inward from the support member 55, thereby forming a vertical slot 61, which receives the outer flange 19 of the apron 18. Formed on the lower end of the biasing arm 52 is a hook 54 configured to automatically engage the upper lip 14' on the lower bucket 5' when the two buckets 5, 5' are stacked. During use, the user's finger 99 presses the upper section 53 of the biasing arm 52 which forces the hook 54 outward and disengage from the upper lip 14'.

FIGS. 17-21 show a third embodiment of the bucket connector, indicated by reference number 70. The bucket connector 70 includes a biasing arm 72 with a diagonally aligned upper section 73 that partially extends into the apron cavity 21 formed on the apron 18. The biasing arm 72 also includes a lower portion 75 that extends below the apron cavity 21. Formed on the lower portion 75 is an inward-directed hook 74 configured to automatically engage the upper lip 14' formed on the lower bucket 5' when the upper bucket 5 is forced into and stacked over the lower bucket 5'. The upper section 73 of the biasing arm 72 is V-shaped and includes a straight support leg 76 configured to rest against the inside surface of the apron 18. Formed on the distal end is an abutment arm 77 that extends outward and presses against the upper lip 14' and prevents downward movement of the upper bucket 5 on the lower bucket 5'. A space is created between the tip of hook 74 and abutment arm 77, allowing the upper lip 14' to move upward and downward to engage and disengage the hook 74.

Formed on the upper section 73 of the biasing arm 72 is an optional peg 80 that slides into a hole 20 formed on the outside surface of the apron 18. By inserting the peg 80 into the hole 20, the bucket connector 70 becomes locked into the apron 18.

Figure 20:
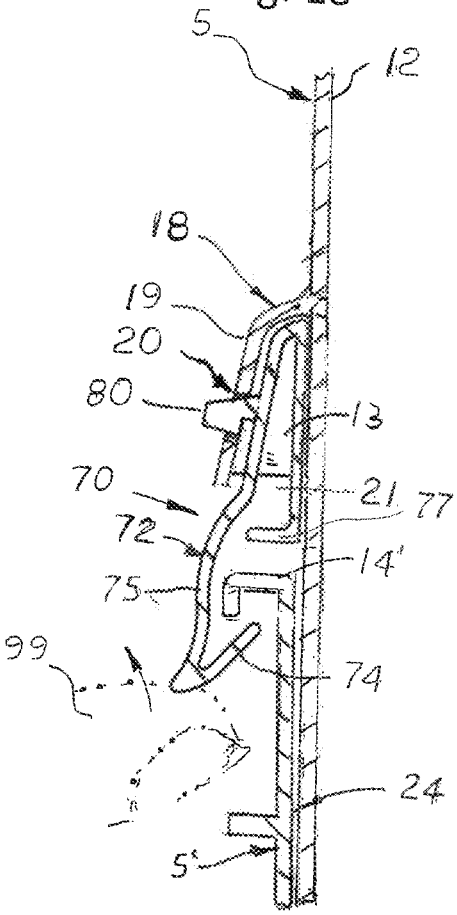
FIG. 20 is a sectional side elevational view of the clip shown in FIGS. 17-19 being used to hold two stacked buckets together.

As shown in FIG. 20, the user uses his finger to apply upward pressure on the pointed, finger lifting surface on the biasing arm 72. The hook 74 formed on the end of the finger lifting surface extends upward and inward to capture the upper lip 14' on the lower bucket 5'. To disengage the hook 74 from the upper lip 14', the applies an upward force to the finger lifting surface causing it to distort and allowing the upper bucket 5 to be removed from the lower bucket 5'. It should be understood that peg 80 and hole 20 are one way to connect the bucket connector 70 to the apron 18 and that other types of connectors may be used such as mechanical fasteners, adhesives, solvents, thermal or sonic welding, may be used.

Figure 21:
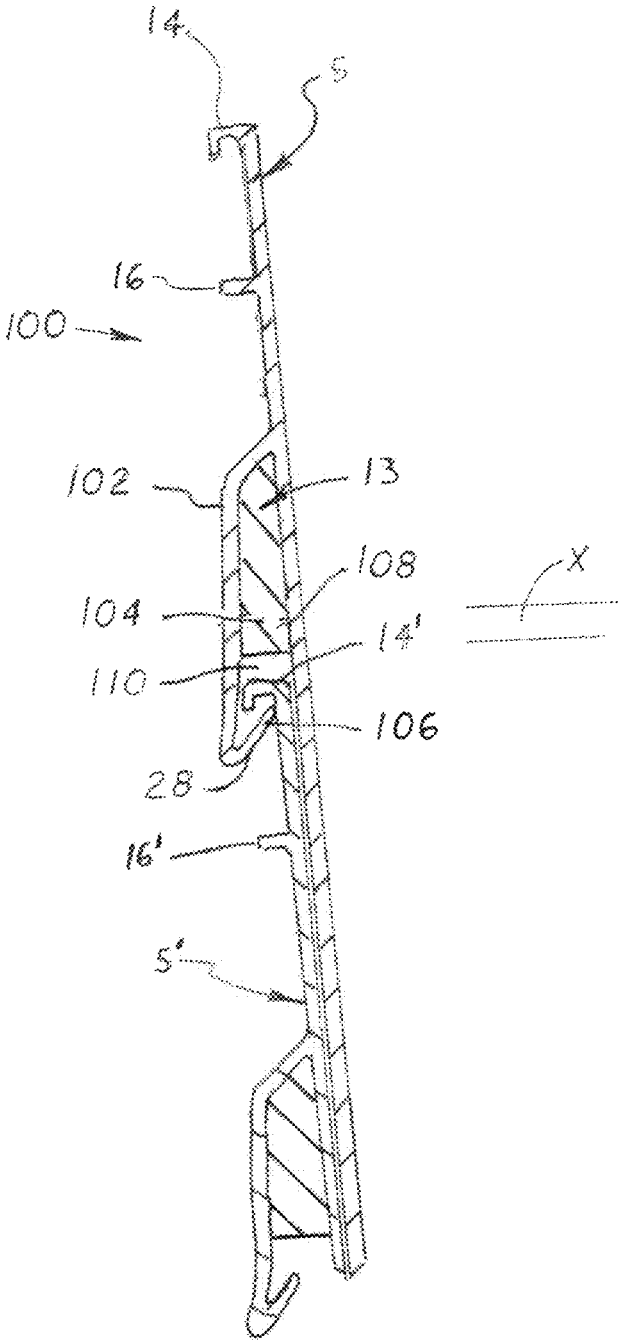
FIG. 21 illustrates a bucket with a modified apron with a hook and a modified partition an inward extending blocking arm located inside the apron's cavity configured to block and prevent excessive upward movement of the upper lip on the lower bucket into the apron cavity. Also, the distal edge of the apron includes a flexible hook that extends inward and captures the upper lip formed on the lower bucket.

FIG. 21 shows a fourth embodiment of the bucket connector indicated by reference number 100 integrated into a modified apron 102 formed on the upper bucket 5. The modified apron 102 includes an integrally formed hook 106 on its lower edge. The hook 106 is configured to capture the upper lip 14' formed on either lower bucket 5' or a standard bucket 5' shown in FIGS. 5-10. The sidewall of the modified apron 102 is made of flexible material, which allows the user to apply an outward bending force to the lower edge to disengage the hook 106 from the upper lip 14'.

The modified apron 102 also includes rib-like partitions 13 that extend outward from the outside surface of the sidewall and support the apron 102. The partitions 13 are spaced apart along the perimeter of the upper bucket 5. Formed or attached to some or all of the partitions 13 are extenders 108 that act as stop surfaces that prevent excessive upward movement of lower bucket 5' on the upper bucket 5. The lower edge of each partition extender 108 extends below the lower edge of the adjacent partitions. In one embodiment, the upper bucket 5 has two partition extenders 108 placed on opposite sides of the apron 102. When the upper bucket 5 with partition extenders 108 is nested and stacked over a lower bucket 5', the upper lip 14' of the lower bucket 5' extends into the lower opening of the apron cavity 110 and engages the hook 106. The lower surface of each partition extender 108 is elevated above the lower opening to the apron cavity 110, thereby enabling the upper lip 14' of the lower bucket 5' to be partially inserted into the apron cavity 110. The distance between the lower surfaces of the partition extenders 108 and the lower opening of the apron cavity 110 is relatively short (approximately ¼ inch) to prevent excessive upward movement of the upper lip 14' on the lower bucket 5' into the apron cavity 110.

In all of the embodiments, when the buckets are nested and stacked, an air gap is maintained between the sidewalls of the upper and lower buckets. The actual width of the air gap depends on the draft of the buckets and how far the upper bucket fits into the storage cavity in the lower bucket. Typically, the air gap is 1/32 to 1/8 inches wide. In a typical bucket with a modified apron and partition extenders discussed above, the draft of each bucket is between 1 to 3 degrees (typically 1.75 degrees). The lower edges of the partition extenders extend approximately 0.3 inches (indicated by the letter 'X' in FIG. 21) below the lower edges of the adjacent partitions.

In compliance with the statute, the invention described has been described in language more or less specific on structural features. The invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

We claim:

1. A connector used to attach an upper bucket to a lower bucket aligned in a stacked orientation, each said bucket being frustoconical with converging sidewall, a center storage cavity, a top opening, an upper lip formed on said sidewall near said top opening, and at least one apron extending outward from said sidewall and below said upper lip, said connector comprising:

a. a biasing arm extending downward from said apron, said biasing arm includes a hook configured to automatically engage said upper lip on said lower bucket when said upper bucket is stacked inside said storage cavity in said lower bucket thereby locking said upper bucket and said lower bucket together in a stacked configuration, said biasing arm configured to be selectively moved to disengage said hook from said upper lip on said lower bucket enabling stacked said buckets to separate; and b. a stop surface formed on said biasing arm or said apron configured to limit a downward movement of said upper bucket into said storage cavity in said lower bucket, said stop surface configured so that an air gap is formed between adjacent said side-walls of said buckets when said upper bucket is stacked over said lower bucket.

2. The connector as recited in claim 1, further including a support member attached to said biasing arm, said support member includes a slot configured to capture an upper ring formed on said upper bucket.

3. The connector as recited in claim 1, further including an alignment arm attached to said biasing arm configured to fit inside said apron and press against an area of said sidewall of said upper bucket adjacent to said apron.

4. The connector as recited in claim 3, wherein said stop surface is a vertical leg extending downward from an abutment arm.

5. The connector as recited in claim 3, wherein an abutment arm includes the alignment arm extending upward arm configured to extend into said apron and press against said sidewall adjacent to said apron.

6. The connector as recited in claim 1, wherein said biasing arm being configured to partially fit inside said apron and includes an elongated hook that extends downward from said apron.

7. The connector as recited in claim 6, wherein said biasing arm includes a peg that selectively engages a hole formed on said apron to lock said biasing arm onto said apron.

8. The connector as recited in claim 7, wherein said biasing arm includes the hook that captures said upper lip formed on said lower bucket.

9. The connector as recited in claim 1, wherein said biasing arm partially extends below said apron and includes the hook configured to capture said upper lip on said lower bucket.

10. The connector as recited in claim 9, wherein said stop surface is a partition formed inside said apron.

* * * * *